United States Patent [19]

Olsson

[11] 4,136,992

[45] Jan. 30, 1979

[54] METHOD OF STABILIZING GROUND OF LOW BEARING CAPACITY, AND A STABILIZING UNIT FOR CARRYING OUT THE METHOD

[76] Inventor: Gunnar Olsson, Svartkarrsvagen 24, 133 00 Saltsjobaden, Sweden

[21] Appl. No.: 875,936

[22] Filed: Feb. 7, 1978

[30] Foreign Application Priority Data

Feb. 11, 1977 [SE] Sweden ..... 015733/77

[51] Int. Cl.[2] ..... E01C 21/00

[52] U.S. Cl. ..... 404/76; 404/108; 404/101

[58] Field of Search ..... 404/76, 77, 75, 72, 404/83, 90, 101, 108; 61/36 R, 36 A

[56] References Cited

U.S. PATENT DOCUMENTS

| | | | |
|---|---|---|---|
| 1,399,681 | 12/1921 | Austin | 404/77 |
| 2,196,211 | 4/1940 | Hartman | 61/36 R |
| 2,387,764 | 10/1945 | Maxwell | 404/101 X |
| 2,649,060 | 8/1953 | Hawkins | 404/77 X |
| 2,649,061 | 8/1953 | Hawkins | 404/77 X |
| 2,995,457 | 8/1961 | Lyons | 61/36 R |
| 3,091,999 | 6/1963 | MacDonald | 404/101 |
| 3,478,656 | 11/1969 | McDonald | 404/76 |
| 3,546,886 | 12/1970 | Jones | 61/36 R |
| 3,596,577 | 8/1971 | Chennells | 404/76 X |
| 4,075,853 | 2/1978 | Champfew | 404/105 X |

*Primary Examiner*—Nile C. Byers, Jr.

*Attorney, Agent, or Firm*—Fleit & Jacobson

[57] ABSTRACT

In a method of stabilizing, by means of a stabilizing machine adapted to inject a stabilizing agent into the ground, a ground surface whose bearing capacity is so low that it is unable to support the stabilizing machine or can only support said machine with difficulty, there is used a stabilizing unit supported by the drive or transport unit of said machine in front thereof as seen in the drive direction. The stabilizing unit has a width which exceeds the width of said drive or transport unit. The stabilizing agent is introduced into the ground to a depth of such magnitude, and the machine is driven at such a speed that the ground is sufficiently stabilized by said stabilizing agent introduced thereinto to support the whole of the stabilizing machine. The stabilizing unit may be partially supported by lifting and/or carrying arms of the drive unit and partially by separate ground-engaging tracks or wheels arranged between said unit and said drive unit.

The means for introducing stabilizing agent into the ground may be provided with support surfaces arranged to engage the surface of the ground so as to assist in supporting the weight of said unit.

The invention also concerns a stabilizing unit for carrying out the method and having means for connecting it to a tractor or a similar vehicle so that it is supported in front thereof.

10 Claims, 11 Drawing Figures

Figure 1:
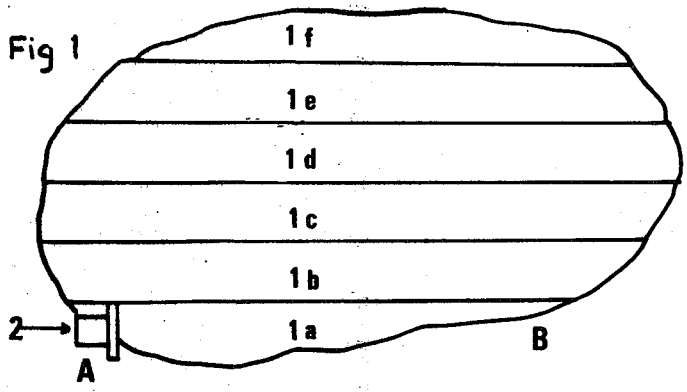

METHOD OF STABILIZING GROUND OF LOW BEARING CAPACITY, AND A STABILIZING UNIT FOR CARRYING OUT THE METHOD

It is often necessary to reinforce the ground upon which roads are to be built and buildings erected because of its low bearing capacity. In one method of reinforcing the ground to increase its bearing capacity desired, the earth is removed and replaced by sand, gravel or the like. Alternatively, the ground can be stabilized by means of ground stabilized machines adapted to meter, distribute and admix binding agent and water in the ground. The binding agent may be lime and/or cement. The machine comprises stabilized devices by which the binding agent is injected in vertically extending layers in the ground and caused to be mixed with the earth by tools which cause the earth with the binding agent layer to move in a streamlike flow. The speed of the tools and the pattern in which they move result in a turbulent like movement in the ground. The result of this admixing method is normally satisfactory after the stabilized means has carried out a number of sweeps over the ground being reinforced, in that the admixture of cement and/or lime and water in the earth is then sufficient to have strengthened the ground.

The use of such a stabilized machine, however, is only possible when the bearing capacity of the ground is sufficient to carry the machine. In those cases when the ground is too weak to carry the machine, or is too uneven, it has not been possible hitherto to stabilize the ground by means of such a machine.

An object of the present invention is to permit such a stabilizing machine to be used for stabilizing ground which is very uneven or which has a low bearing capacity. Another object is to reduce the layout for stabilizing equipment and to save energy.

The method according to the invention is based on the concept of introducing into the ground a stabilizing agent which will impart to the ground an increased stability relatively quickly. The method according to the invention is characterised in that the ground is stabilized to a width exceeding the width of the machine by means of a stabilizing unit carried in front of the drive unit of the machine as seen in the drive direction thereof; that the stabilizing agent is admixed to a depth such and that the machine is driven at a speed such that the ground is imparted by said admixed agent sufficient stability to support the stabilizing machine.

When carrying out the method, the stabilizing machine has no ground-engaging wheels or tracks in front of the stabilizing unit as seen in the drive direction thereof. As a result of the rapid action of the stabilizing agent introduced into the ground, the surface of the ground is moved and stabilized before the wheels or tracks of the drive unit pass over said surface.

It is preferred in practice that the stabilizing unit is supported at least partially by lifting and supporting arms carried by the drive unit. This has been found possible in practice, despite the comparatively heavy weight of the stabilizing unit and its content. Thus, the stabilizing devices inserted into the ground contribute, to a certain extent, to releaving the load on the drive unit, thereby avoiding the risk of the unit tilting over or tipping.

In accordance with one embodiment of the invention, the stabilizing unit is also carried by separate ground-engaging tracks or wheels arranged between the stabilizing unit and the drive unit.

The pressure exerted on the ground by these tracks or wheels, which merely help to carry the stabilizing unit, is not as great as that exerted by the tracks or wheels of the following drive unit. The stabilizing effect, which is obtained more or less immediately, provided by the forward stabilizing unit has been found, in practice, sufficient to support the aforementioned support unit between the main part of the stabilizing unit and the drive unit in a satisfactory manner.

In order to further release the load of the stabilizing unit, the mixing devices of said unit inserted into the ground may be provided with support planes engaging the surface of the ground in a manner such as to assist in supporting the unit.

The invention also relates to a ground stabilizing unit for use when carrying out the aforedescribed method, said unit comprising a plurality of stabilizing devices adapted to be inserted into the ground, and is substantially characterised in that the unit comprises a frame having a rear part, as seen in its direction of movement, having means for connecting the same to the carrying and/or lifting arm of a transport unit, e.g. a tractor, said stabilizing unit, when connected to said transport unit, being arranged to be at least partially supported by said unit, e.g. the tractor, and having a width which is greater than the width of said transport unit.

Figure 2:
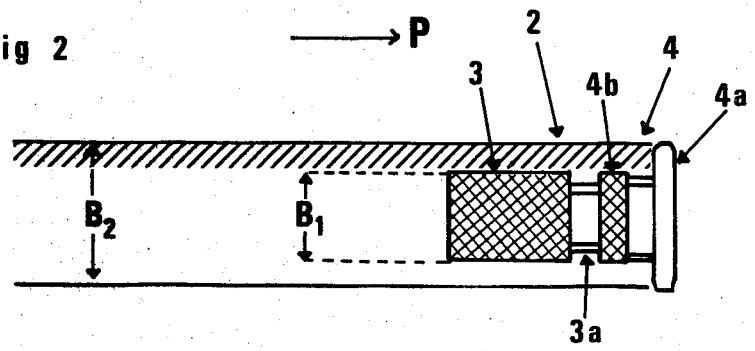
Figure 3:
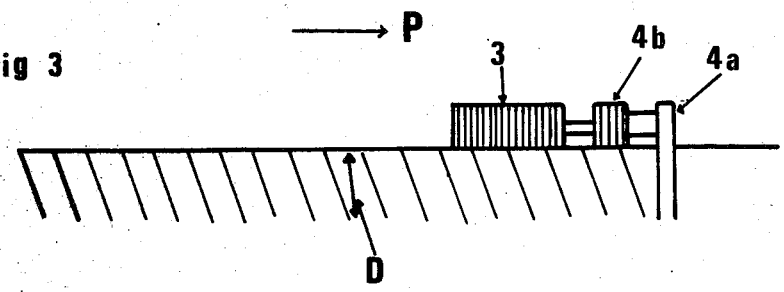
Figure 4:
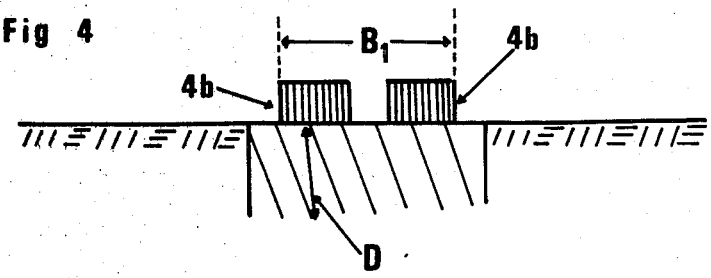
Figure 5:
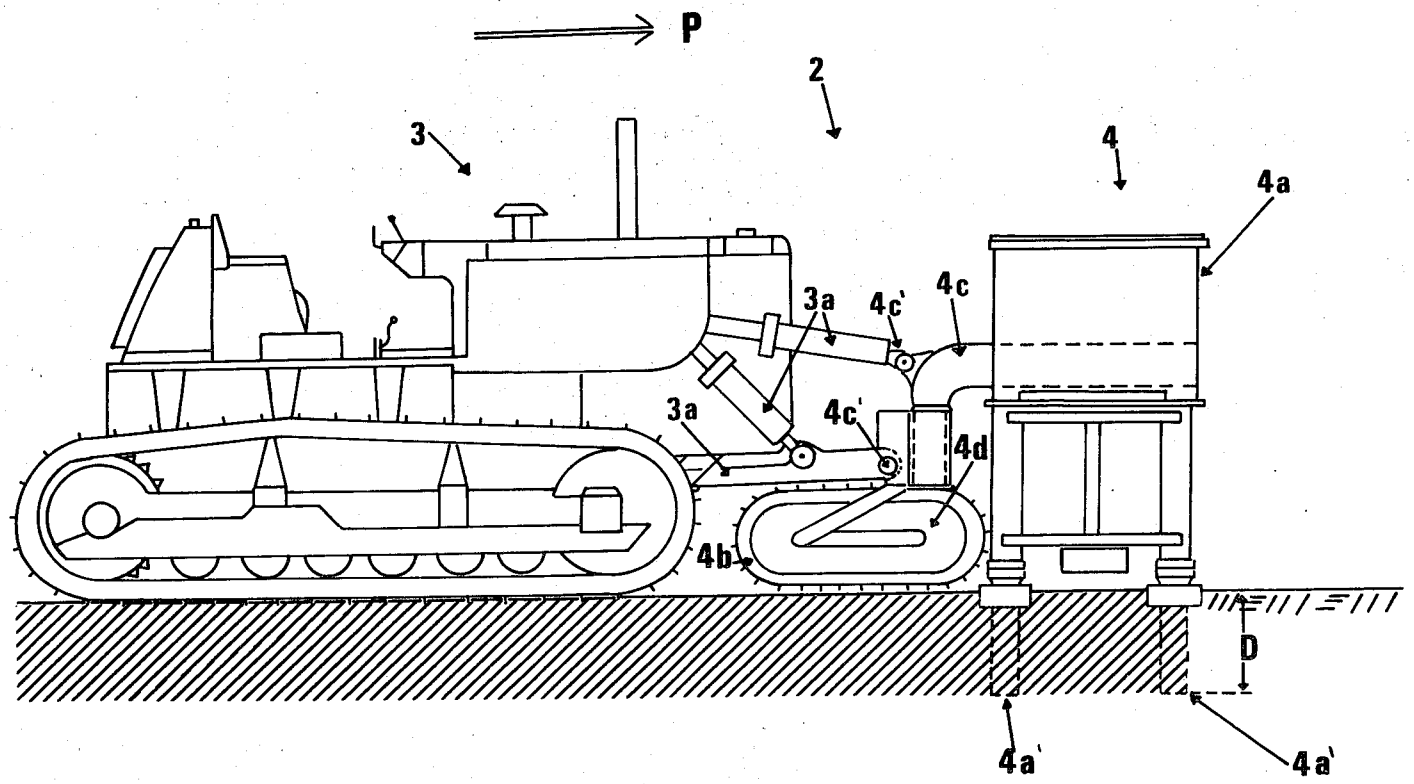
Figure 6:
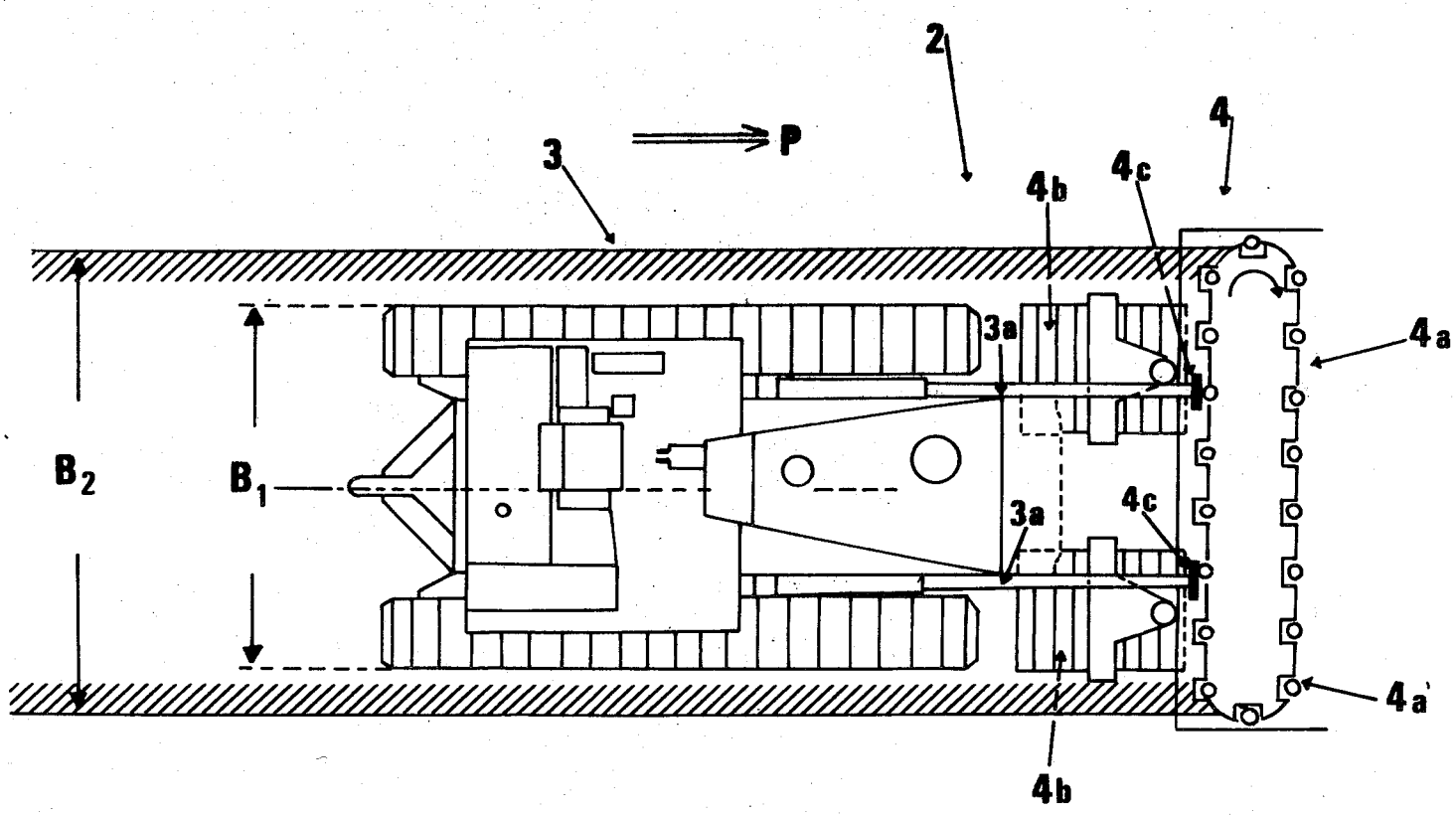
Figure 7:
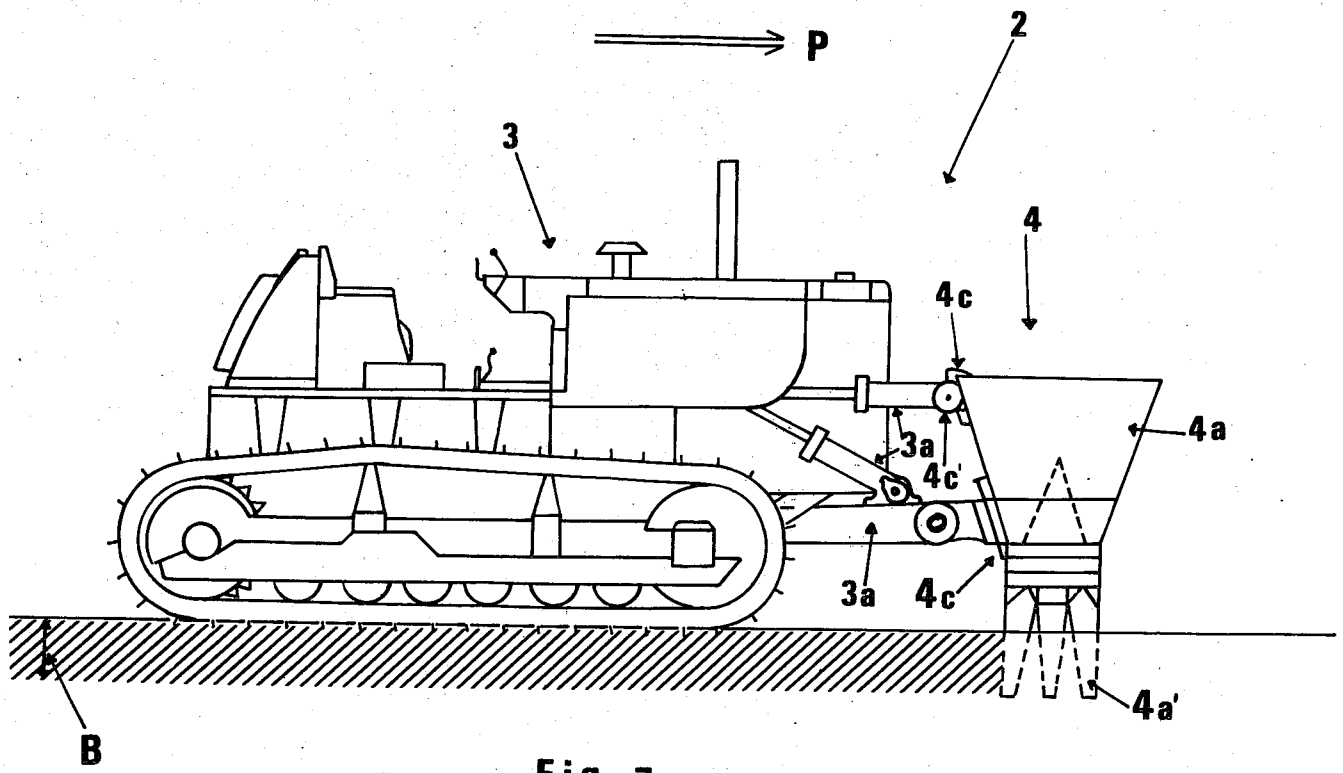
Figure 8:
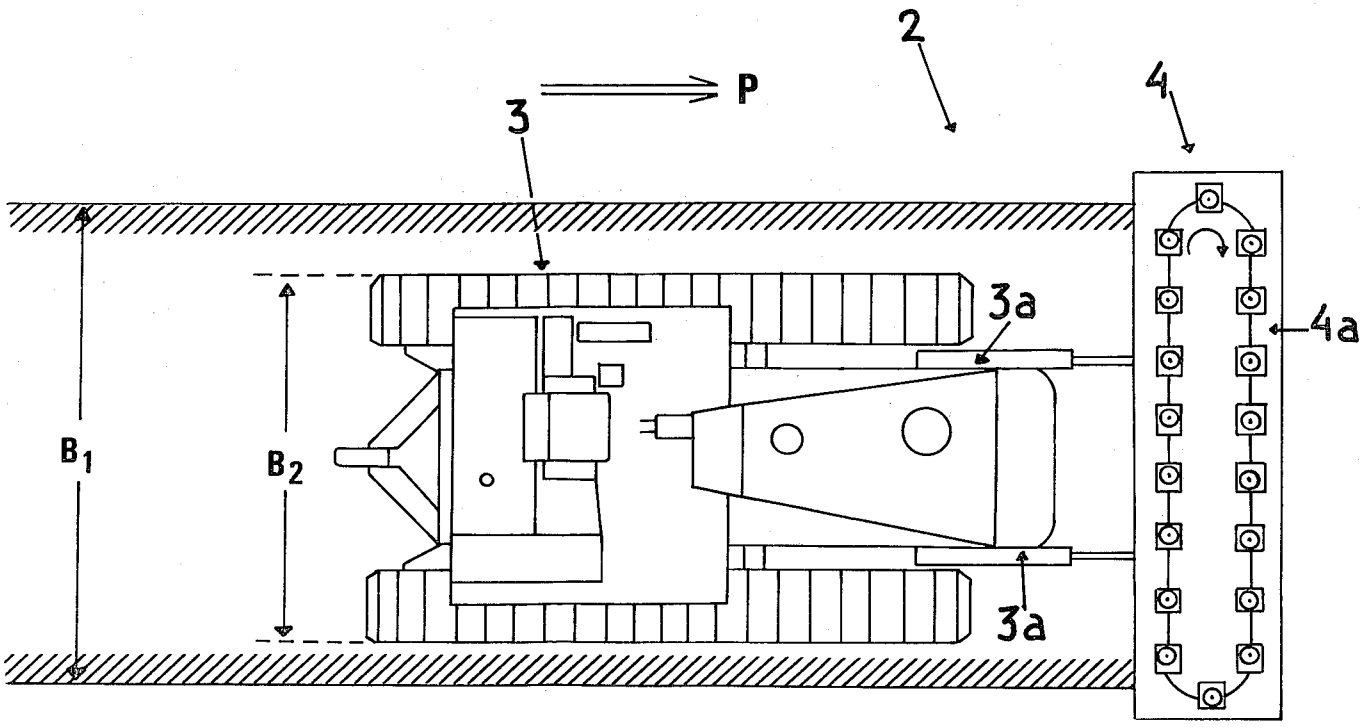

So that the invention will be more readily understood and further features thereof made apparent, a number of exemplary embodiments will now be described with reference to the accompanying schematic drawings, in which:

FIG. 1 is a plan view illustrating the principle of stabilizing an area of ground, FIG. 2 is a plan view of the stabilizing machine in operation on part of said area, FIG. 3 is a longitudinal sectional view through the area shown in FIG. 2, FIG. 4 is a cross-sectional view through the area shown in FIG. 2 during a ground stabilizing operation, FIG. 5 is a side view of a stabilizing machine having a stabilizing unit according to the invention, FIG. 6 is a plan view of the machine shown in FIG. 5, FIG. 7 is a side view of a stabilizing machine having a stabilizing unit of modified embodiment, FIG. 8 is a plan view of the stabilizing machine shown in FIG. 7, and FIGS. 9 to 11 show elements of the stabilizing unit associated with the machine in FIGS. 7 and 8.

In FIG. 1 there is illustrated a stabilizing machine 2 for distributing and mixing stabilizing agent in the ground, said machine being shown to travel from A to B in sweeps 1*a*, 1*b*, 1*c* etc. whilst continuously mixing stabilizing agent with the earth.

Referring to FIG. 2, the machine comprises a drive or transport unit 3 supporting in the front thereof a stabilizing unit 4 having a mixing part 4*a* and a supporting part 4*b*.

Thus, the stabilizing agent is mixed with the ground in front of the support unit 4*b* and drive unit 3 as seen in the direction of movement of the unit. The width $B_2$ of the stabilizing part 4*a* is greater than the width $B_1$ of the drive unit 3. The nature of the ground is assumed to be such that, unless stabilized it is unable to carry the weight of a tractor or a tracked or wheeled vehicle, or can only support the weight of such vehicle with difficulty.

The stabilizing agent is mixed to a depth D (FIG. 3) and the speed of the machine adapted in a manner such that the ground is able to be stabilised sufficiently to support the stabilizing machine 2 when it passes the area stabilized by the unit 4.

The stabilizing machine 2 illustrated in FIGS. 5 and 6 comprises a drive or transport unit in the form of a track-driven tractor and a stabilizing unit 4 carried in front of said tractor for continuously distributing and mixing a stabilizing agent with the ground. The unit 4 has a mixing or stabilizing part 4*a* provided with a plurality of stabilizing agent injection devices 4*a*′ inserted into the ground, and a frame having a back part 4*c* which is joined with the chassis 4*d* of an endless track 4*b* engaging the ground. The frame 4*c* has means 4*c*′ by which it can be connected to supporting or lifting arms 3*a* of the tractor 3. In this way, part of the weight of the stabilizing unit 4 is supported by the tractor, while a further part of said weight is supported by the foundation through the chassis 4*d* and the track 4*b*.

The stabilising unit 4 is arranged to be guided to its correct position relative to the foundation by hydraulically operated arms 3*a* on the tractor.

A further embodiment of the stabilizing unit 4 is illustrated in FIGS. 7 and 8. This embodiment lacks a track with associated chassis engaging the ground. The stabilizing unit 4 is solely supported by the hydraulically operated carrying and lifting arms 3*a* of the tractor 3. In this embodiment, the stabilizing agent injection devices 13 inserted into the ground to inject a stabilizing agent thereinto are provided with support surfaces, or runner 14, as seen in FIGS. 9 to 11, which contribute to lift the unit 4 and thereby reduce the weight carried by the tractor.

Figure 9:
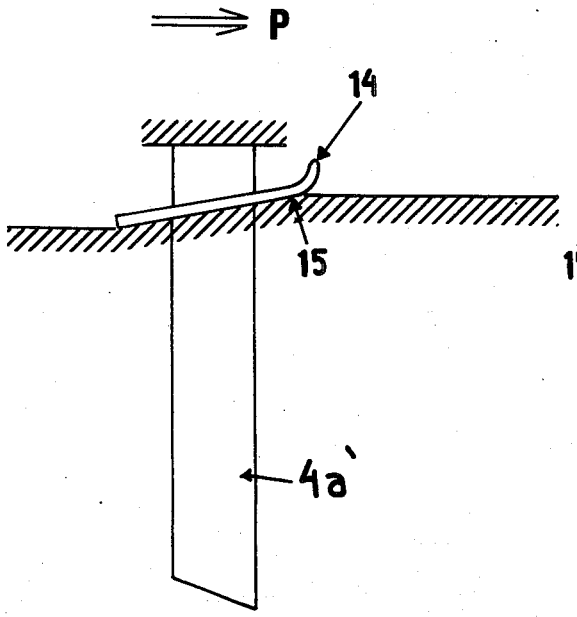
Figure 10:
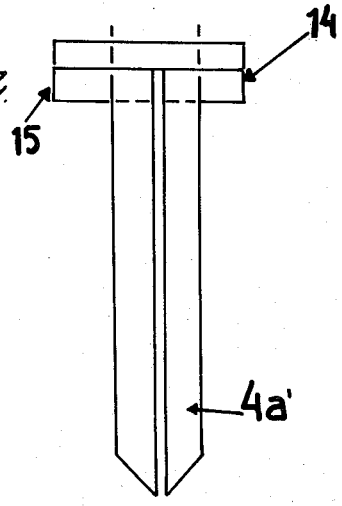
Figure 11:
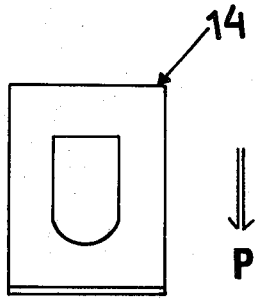

The devices 4*a*′ are arranged to move in the direction of arrows P in FIGS. 9 and 11, earth being compressed under the support surface 14 as shown at 15. The support surface 14 is an inclined surface which presses against the ground, forces occur which contribute to supporting the stabilizing unit 4.

I claim:

1. A method of in situ stabilizing a ground surface whose bearing capacity is so low that it is unable to satisfactorily support a stabilizing machine used to stabilize the surface, the stabilizing machine being adapted to introduce a stabilizing agent into the ground, the method comprising the steps of:

using a stabilizing unit carried in front of a drive unit of the stabilizing machine to stabilize the ground to a width exceeding the width of the drive unit of the stabilizing machine; and introducing the stabilizing agent into the ground to a depth of such magnitude, and driving the machine at such a speed that the ground is sufficiently stabilized by said stabilizing agent introduced thereinto to support the whole of the stabilizing machine.

2. A method according to claim 1 wherein the drive unit has carry arms for at least partially supporting the stabilizing unit.

3. A method according to claim 2 using separate ground-engaging means arranged between said stabilizing unit and said drive unit for supporting the stabilizing unit.

4. A method according to claim 2, wherein the stabilizing unit includes means carried by said stabilizing unit for introducing stabilizing agent into the ground, said introducing means having support surfaces arranged to engage the surface of the ground so as to assist in supporting the weight of said stabilizing unit.

5. An in situ ground stabilizing unit for use with a drive unit having support and lifting arms comprising:

a plurality of stabilizing devices adapted to be inserted into the ground to inject a stabilizing agent thereinto; and a frame for supporting the stabilizing devices and having a rear part, as seen in the direction of movement of said stabilizing unit, said rear part having means for connecting said part to the supporting and lifting arms of the drive unit, whereby when the stabilizing unit is connected to said drive unit said stabilizing unit is arranged to be supported at least partially by said drive unit, and has a greater width than the width of said drive unit so that the stabilizing agent is injected into an area wider than the width of said drive unit.

6. A stabilizing unit according to claim 5 wherein the rear part is joined with a member carrying means for engaging the ground, said member being positioned between the stabilizing devices and the drive unit.

7. A stabilizing unit according to claim 6 wherein said member comprises a tracked support.

8. A stabilizing unit according to claim 6 wherein said member comprises a wheeled support.

9. A stabilizing unit according to claim 5, wherein said stabilizing devices have support surfaces arranged to engage the surface of the ground and at least partially support said stabilizing unit when said stabilizing devices are inserted into the ground.

10. A stabilizing unit according to claim 6 wherein said stabilizing devices have support surfaces arranged to engage the surface of the ground and at least partially support said unit when said stabilizing devices are inserted into the ground.

* * * * *